US010710215B1

(12) United States Patent
Sanchez et al.

(10) Patent No.: US 10,710,215 B1
(45) Date of Patent: Jul. 14, 2020

(54) WORKPIECE-HOLDING DEVICE

(71) Applicants: Rachel Sanchez, Alhambra, CA (US); Antonio Carrillo, Alhambra, CA (US)

(72) Inventors: Rachel Sanchez, Alhambra, CA (US); Antonio Carrillo, Alhambra, CA (US)

( * ) Notice: Subject to any disclaimer, the term of this patent is extended or adjusted under 35 U.S.C. 154(b) by 66 days.

(21) Appl. No.: 16/215,746

(22) Filed: Dec. 11, 2018

(51) Int. Cl.
*B25B 1/20* (2006.01)
*B25B 1/02* (2006.01)

(52) U.S. Cl.
CPC ..... *B25B 1/02* (2013.01)

(58) Field of Classification Search
CPC ..... B25B 1/00; B25B 3/00; B25B 5/00
See application file for complete search history.

(56) References Cited

U.S. PATENT DOCUMENTS 3,083,007 A 3/1963 Campfield
4,323,226 A * 4/1982 Close ..... B25B 1/106 248/220.43
4,418,901 A * 12/1983 Woods ..... B25B 1/22 269/101
4,864,941 A 9/1989 Goulter
5,673,903 A 10/1997 Lewis
5,746,421 A 5/1998 Bowerman
D408,179 S 4/1999 Rellinger
D425,771 S 5/2000 Dearing
6,338,477 B1 * 1/2002 Moore ..... B25B 1/103 269/251
6,367,788 B1 * 4/2002 Babchuk ..... B23K 37/0443 269/45
6,443,441 B1 9/2002 Buitenhuis
8,678,363 B2 * 3/2014 Baker ..... B25B 1/103 269/43

* cited by examiner

*Primary Examiner* — Lee D Wilson
(74) *Attorney, Agent, or Firm* — Kyle A. Fletcher, Esq.

(57) ABSTRACT

The workpiece-holding device is a vice with sliding jaws. The workpiece-holding device maintains an object known as a workpiece in a fixed position during shaping operations. The workpiece-holding device comprises a pedestal, a plurality of clamping elements, and a plurality of fastening structures. The plurality of fastening structures attach the plurality of clamping elements to the pedestal. The plurality of clamping elements hold the workpiece in a fixed position. The pedestal further comprises a plurality of adjustment structures. The plurality of adjustment structures allow the plurality of clamping elements to slide along the major axis of the pedestal. The plurality of adjustment structures allow the plurality of clamping elements to slide along a plate major axis of the pedestal.

19 Claims, 6 Drawing Sheets

WORKPIECE-HOLDING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of performing operations and shaping including bench devices not otherwise provided for, more specifically, a vice with sliding jaws. (B25B1/02)

SUMMARY OF INVENTION

The workpiece-holding device is a vice with sliding jaws. The workpiece-holding device maintains an object known as a workpiece in a fixed position during shaping operations. The workpiece-holding device comprises a pedestal, a plurality of clamping elements, and a plurality of fastening structures. The plurality of fastening structures attach the plurality of clamping elements to the pedestal. The plurality of clamping elements hold the workpiece in a fixed position. The pedestal further comprises a plurality of adjustment structures. The plurality of adjustment structures allow the plurality of clamping elements to slide along the major axis of the pedestal. The plurality of adjustment structures allow the plurality of clamping elements to slide along a plate major axis of the pedestal.

These together with additional objects, features and advantages of the workpiece-holding device will be readily apparent to those of ordinary skill in the art upon reading the following detailed description of the presently preferred, but nonetheless illustrative, embodiments when taken in conjunction with the accompanying drawings.

In this respect, before explaining the current embodiments of the workpiece-holding device in detail, it is to be understood that the workpiece-holding device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the workpiece-holding device.

It is therefore important that the claims be regarded as including such equivalent construction insofar as they do not depart from the spirit and scope of the workpiece-holding device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
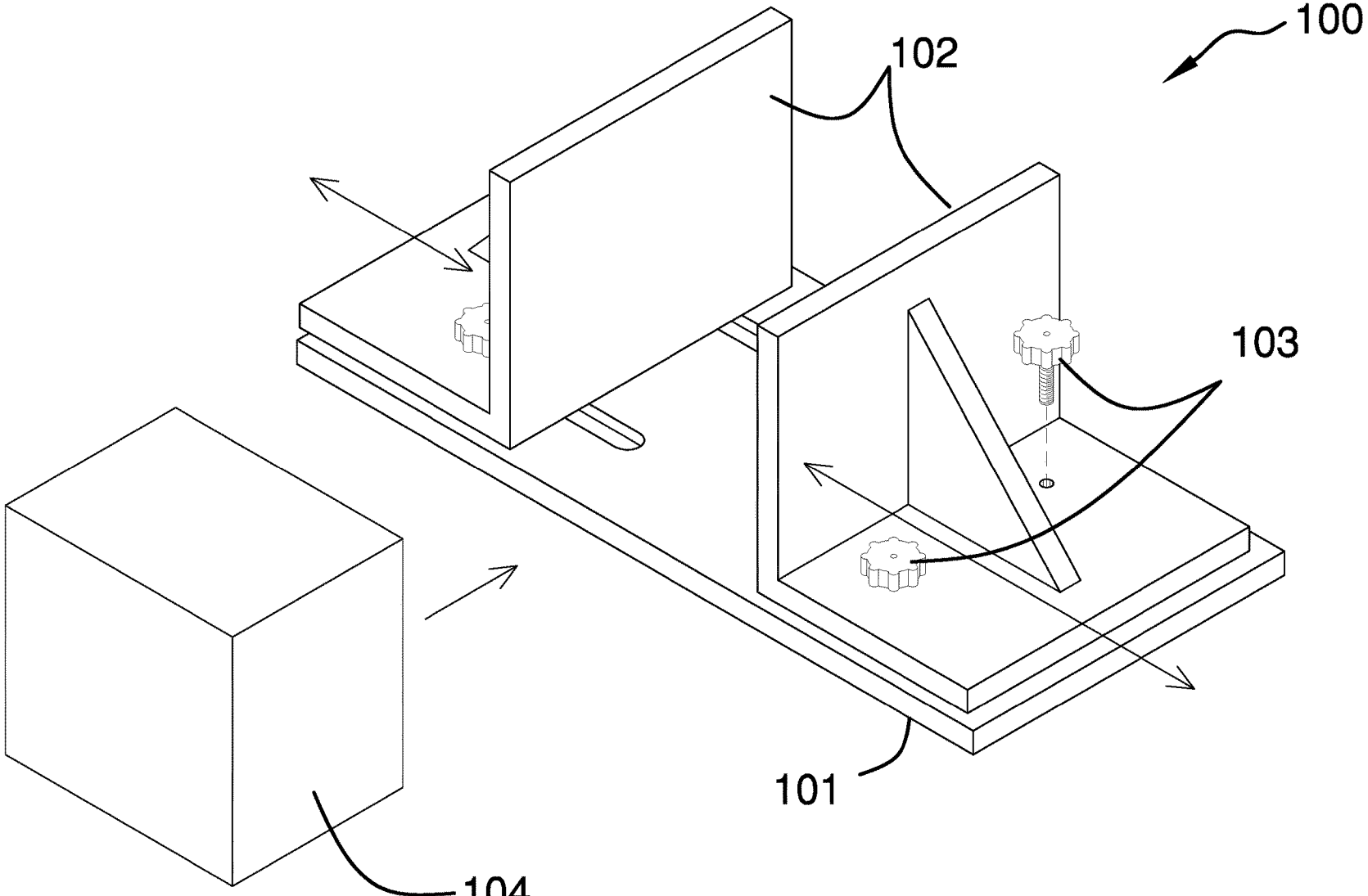
FIG. 1 is a perspective view of an embodiment of the disclosure.
Figure 2:
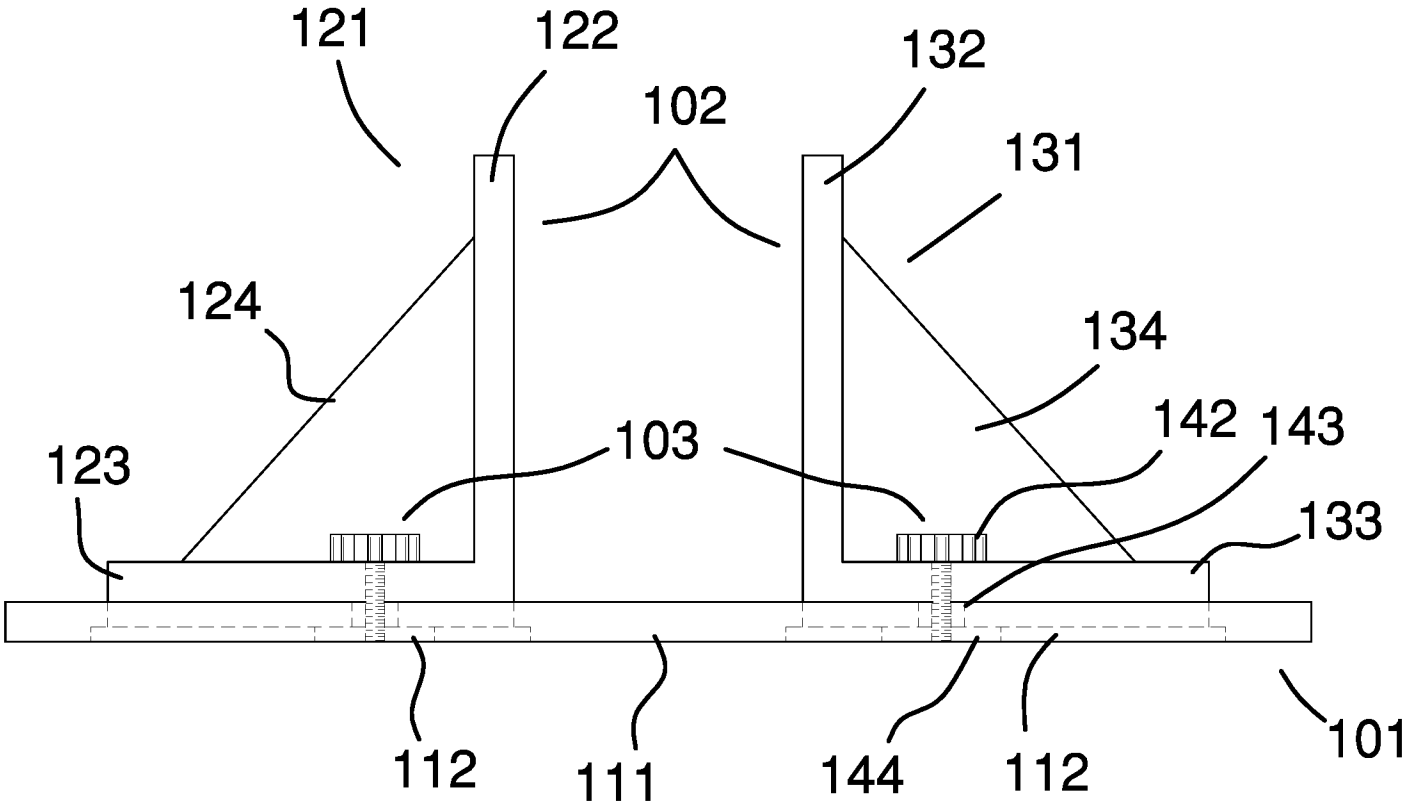
FIG. 2 is a front view of an embodiment of the disclosure.
Figure 3:
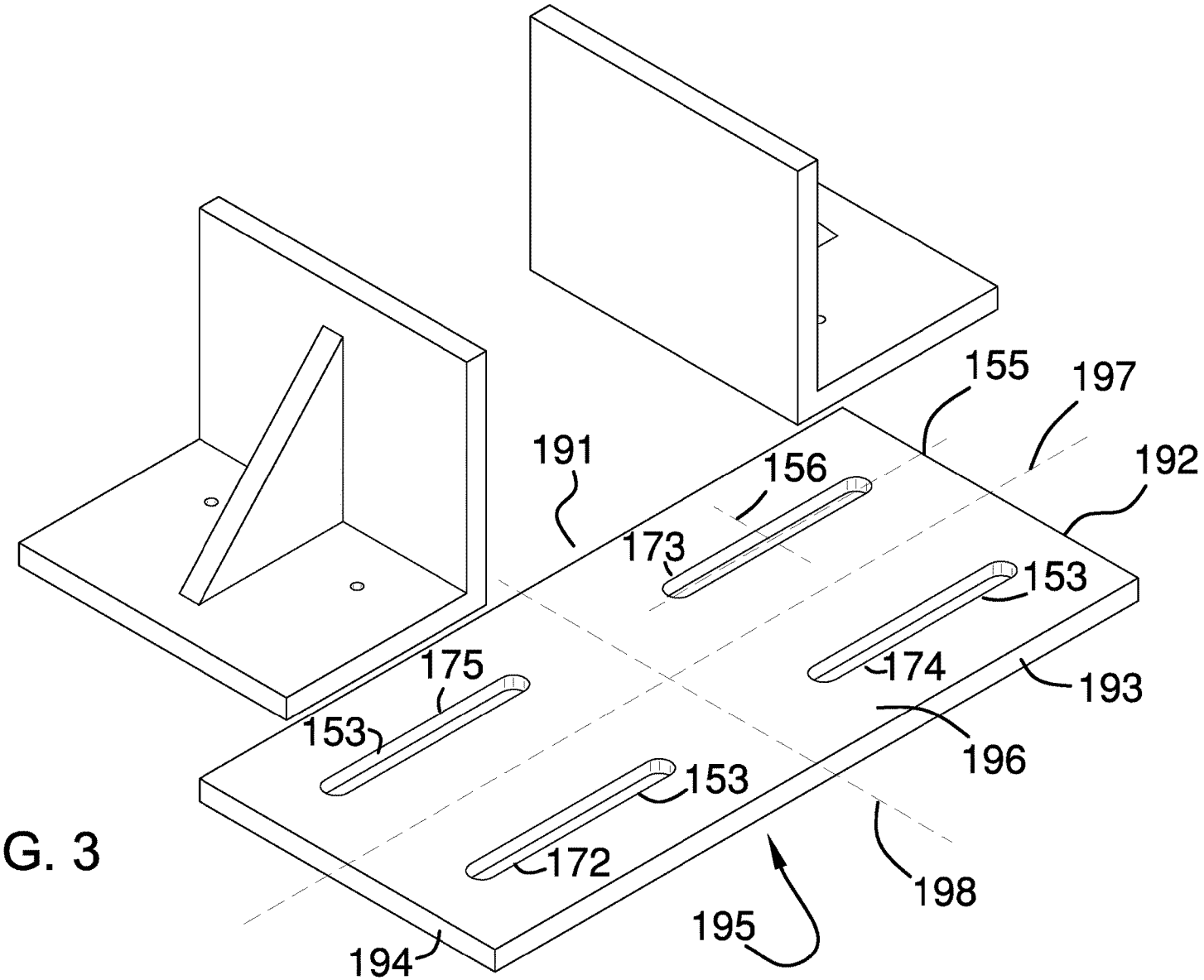
FIG. 3 is an exploded view of an embodiment of the disclosure.
Figure 4:
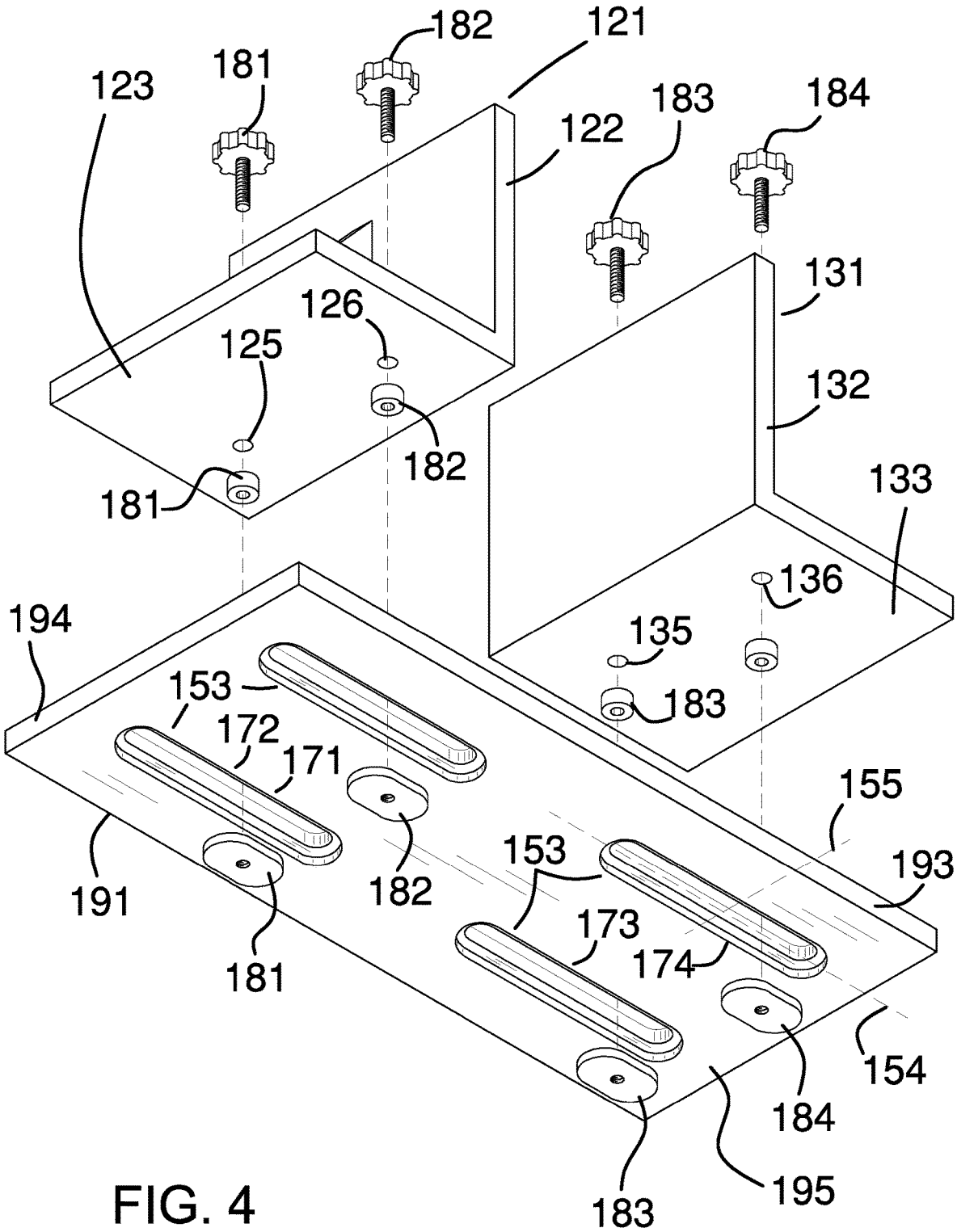
FIG. 4 is a reverse exploded view of an embodiment of the disclosure.
Figure 5:
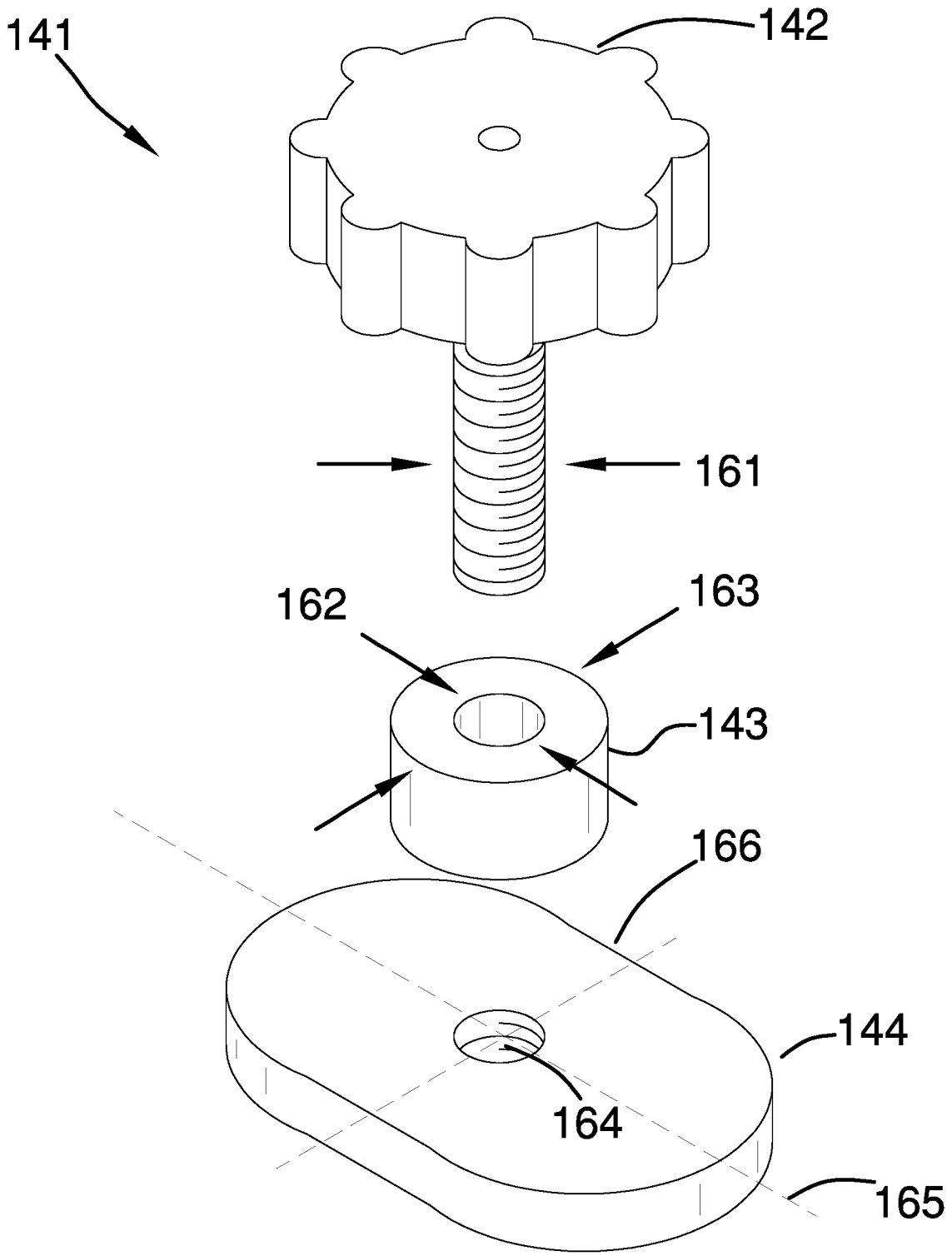
FIG. 5 is a detail view of an embodiment of the disclosure.
Figure 6:
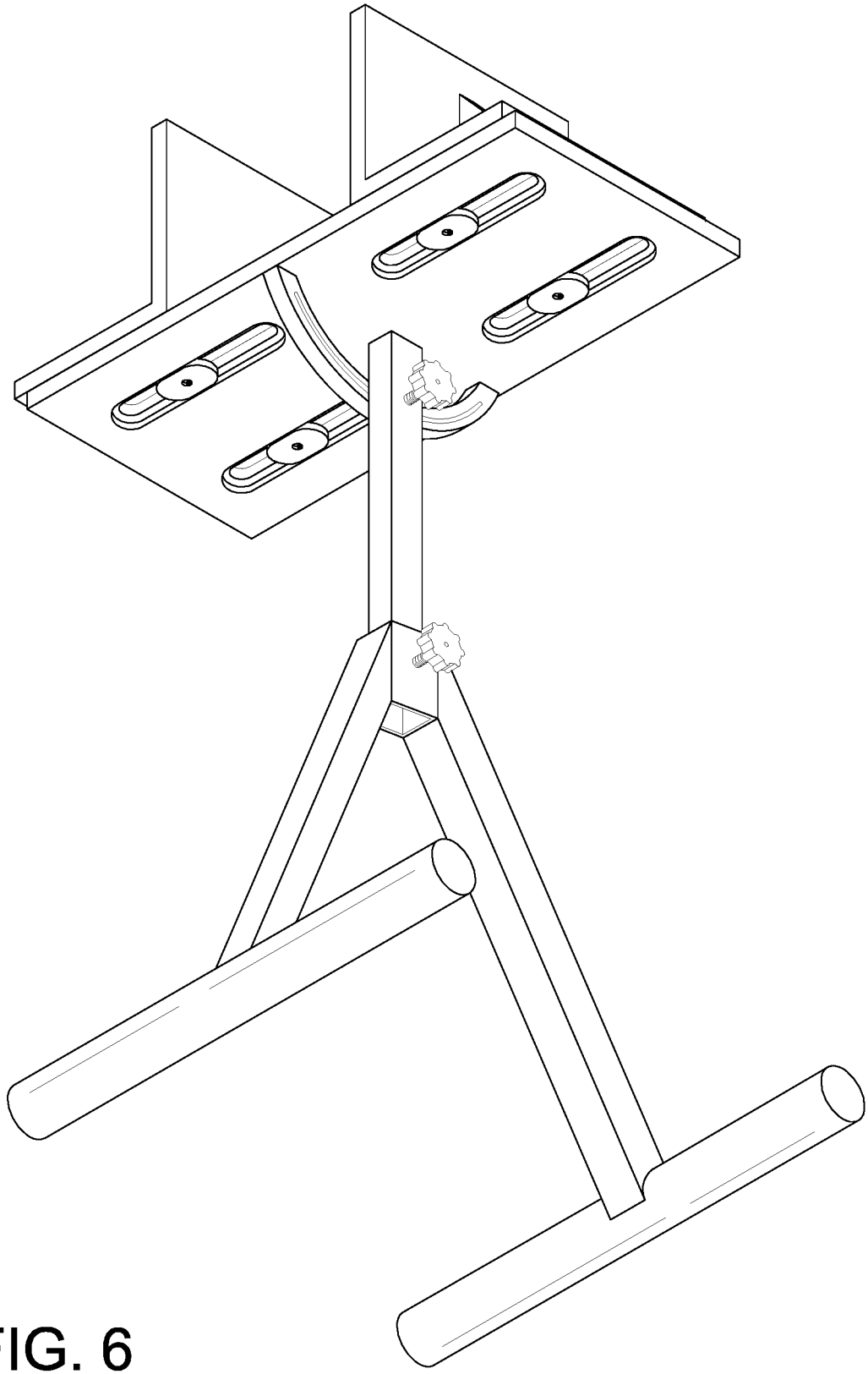
FIG. 6 is a perspective view of an embodiment of the disclosure with an attached work stand.

Detailed reference will now be made to one or more potential embodiments of the disclosure, which are illustrated in FIGS. 1 through 6.

The workpiece-holding device 100 (hereinafter invention) is a vice with sliding jaws. The invention 100 maintains an object known as a workpiece 104 in a fixed position during shaping operations. The invention 100 comprises a pedestal 101, a plurality of clamping elements 102, and a plurality of fastening structures 103. The plurality of fastening structures 103 attach the plurality of clamping elements 102 to the pedestal 101. The plurality of clamping elements 102 hold the workpiece 104 in a fixed position. The pedestal 101 further comprises a plurality of adjustment structures 112. The plurality of adjustment structures 112 allow the plurality of clamping elements 102 to slide along a plate major axis 197 of the pedestal 101.

The pedestal 101 forms the inferior structure of the invention 100. The pedestal 101 is a plate structure. The pedestal 101 has a disk shape. The pedestal 101 has a rectangular block shape. The pedestal 101 transfers the load path of the workpiece 104, the plurality of clamping elements 102, and the plurality of fastening structures 103 to a supporting surface. The inferior face 195 of the pedestal 101 rests on the supporting surface. The plurality of fastening structures 103 removably attaches the plurality of clamping elements 102 to the superior face 196 of the pedestal 101. The plurality of fastening structures 103 attaches the plurality of clamping elements 102 to the superior face 196 such that the position of each of the plurality of clamping elements 102 is adjustable.

The pedestal 101 comprises a master plate 111 and a plurality of adjustment structures 112. The master plate 111 is a rectangular plate structure that forms the base structure of the pedestal 101. The master plate 111 forms the disk structure of the pedestal 101. The master plate 111 is further defined with a first lateral edge 191, a second lateral edge 192, a third lateral edge 193, a fourth lateral edge 194, an inferior face 195, a superior face 196, a plate major axis 197, and a plate minor axis 198.

The first lateral edge 191 is the edge of the master plate 111 with the greatest span of length. The second lateral edge 192 is the edge of the master plate 111 with the least span of length. The third lateral edge 193 is the edge of the master plate 111 that is distal from the first lateral edge 191. The fourth lateral edge 194 is the edge of the master plate 111 that is distal from the second lateral edge 192. The inferior face 195 is the face of the master plate 111 that rests on the supporting surface during use of the invention 100. The superior face 196 is the face of the master plate 111 that is distal from the fourth lateral edge 194. The plate major axis 197 is the center axis of the master plate 111 that is parallel to the first lateral edge 191. The superior face 196 is the center axis of the master plate 111 that is parallel to the second lateral edge 192.

The plurality of adjustment structures 112 comprises a collection of cavities and apertures formed in the master plate 111. The major axes of the plurality of adjustment structures 112 align with the plate major axis 197 of the master plate 111 such that the position of the plurality of fastening structures 103 of the superior face 196 of the master plate 111 can adjust along the direction of the plate major axis 197 of the master plate 111. Each of the plurality of adjustment structures 112 are identical. The plurality of adjustment structures 112 comprises a collection of individual adjustment structures 151. Each of the individual adjustment structure 151 is identical.

Each of the individual adjustment structure 151 is a negative space formed in the master plate 111. The individual adjustment structure 151 has a composite prism structure. The individual adjustment structure 151 forms an anchor point to which an individual fastening structure 141 attaches. Each individual adjustment structure 151 comprises an inferior recess 152 and a superior slot 153. The inferior recess 152 is further defined with a recess major axis 154 and a recess minor axis 155. The superior slot 153 is further defined with a slot major axis 156 and a slot minor axis 157.

The inferior recess 152 is negative space that forms a cavity within the master plate 111. The inferior recess 152 forms a disk structure. The inferior recess 152 has an oval prism shape. The inferior recess 152 is formed in the master plate 111 such that a face of the inferior recess 152 forms an opening through the inferior face 195 of the master plate 111. The face of the inferior recess 152 that is distal from the inferior face 195 is formed within the interior of the master plate 111.

The superior slot 153 is negative space that forms a cavity within the master plate 111. The superior slot 153 has a disk shape. The superior slot 153 is formed in the master plate 111 such that a face of the superior slot 153 forms an opening through the superior face 196 of the master plate 111. The superior slot 153 is formed in the master plate 111 such that a face of the superior slot 153 forms an opening into the inferior recess 152. The superior slot 153 provides access into the inferior recess 152 for the clamping bolt 142. The superior slot 153 is positioned relative to the inferior recess 152 such that the negative spaces of the superior slot 153 and the inferior recess 152 combine to form a negative space in the shape of a composite prism within the master plate 111.

The recess major axis 154 is the major axis of the oval that forms the prism structure of the inferior recess 152. The recess major axis 154 is parallel to the first lateral edge 191 of the master plate 111. The recess minor axis 155 is the minor axis of the oval that forms the prism structure of the inferior recess 152. The recess major axis 154 is parallel to the second lateral edge 192 of the master plate 111. The slot major axis 156 is the major axis of the oval that forms the prism structure of the superior slot 153. The slot major axis 156 is parallel to the first lateral edge 191 of the master plate 111. The slot minor axis 157 is the minor axis of the oval that forms the prism structure of the superior slot 153. The slot minor axis 157 is parallel to the second lateral edge 192 of the master plate 111.

The span of the length of the slot major axis 156 is less than the span of the length of the recess major axis 154. The span of the length of the slot minor axis 157 is less than the span of the length of the recess minor axis 155. The span of the length of the recess minor axis 155 is less than the span of the length of the recess major axis 154. The span of the length of the slot minor axis 157 is less than the span of the length of the slot major axis 156.

The plurality of clamping elements 102 form the elements of the invention 100 that hold the workpiece 104 in a fixed position. The plurality of clamping elements 102 form two vertical surfaces that press against the workpiece 104 such that the workpiece 104 is held in the fixed position. The position of each of the plurality of clamping elements 102 on the superior face 196 of the pedestal 101 is adjustable. The plurality of clamping elements 102 comprises a first clamping element 121 and a second clamping element 131.

The first clamping element 121 forms a first element of the plurality of clamping elements 102. The first clamping element 121 presses against the workpiece 104 from a first side to hold the workpiece 104 in position. The first clamping element 121 forms a rectilinear structure. The first clamping element 121 comprises a first horizontal plate 122, a first vertical plate 123, and a first gusset 124.

The first horizontal plate 122 is a rectangular plate structure. The first horizontal plate 122 is a disk. The first horizontal plate 122 is the structure of the first clamping element 121 that rests on the superior face 196 of the master plate 111. A face of the first horizontal plate 122 rests on the superior face 196 of the master plate 111. The first horizontal plate 122 further comprises a first bolt hole 125 and a second bolt hole 126.

The first bolt hole 125 is a negative space formed through the faces of the disk shape of the first horizontal plate 122. The first bolt hole 125 has a cylindrical shape. The center axis of the first bolt hole 125 is perpendicular to the faces of the first horizontal plate 122. The first bolt hole 125 is sized to receive a clamping bolt 142 of an individual fastening structure 141 selected from the plurality of fastening structures 103. The position of the first bolt hole 125 on the master plate 111 aligns with an adjustment structure selected from the plurality of adjustment structures 112 such that the selected clamping bolt 142 will insert into the selected alignment structure.

The second bolt hole 126 is a negative space formed through the faces of the disk shape of the first horizontal plate 122. The second bolt hole 126 has a cylindrical shape. The center axis of the second bolt hole 126 is perpendicular to the faces of the first horizontal plate 122. The second bolt hole 126 is sized to receive a clamping bolt 142 of an individual fastening structure 141 selected from the plurality of fastening structures 103. The position of the second bolt hole 126 on the master plate 111 aligns with an adjustment structure selected from the plurality of adjustment structures 112 such that the selected clamping bolt 142 will insert into the selected alignment structure.

The first vertical plate 123 is a rectangular plate structure. The first vertical plate 123 is a disk. The first vertical plate 123 attaches to the first horizontal plate 122 such that the faces of the first vertical plate 123 are perpendicular to the faces of the first horizontal plate 122. A lateral edge of the first vertical plate 123 rests on the superior face 196 of the master plate 111. The first vertical plate 123 forms the vertical surface of the first clamping element 121 that presses against the workpiece 104.

The first gusset 124 is a plate structure. The first gusset 124 is a disk. The first gusset 124 has a right triangular shape. The first gusset 124 attaches the first horizontal plate 122 to the first vertical plate 123 such that the hypotenuse of the first gusset 124 is parallel to neither: a) the faces of the first horizontal plate 122; nor, b) the faces of the first vertical plate 123. The first gusset 124 forms a bracing structure that holds the first vertical plate 123 in a fixed position when the first vertical plate 123 presses against the workpiece 104.

The second clamping element 131 forms a first second of the plurality of clamping elements 102. The second clamping element 131 presses against the workpiece 104 from a second side to hold the workpiece 104 in position. The position of the second clamping element 131 is positioned against the workpiece 104 in diametric opposition to the first clamping element 121. The second clamping element 131 is positioned on the master plate 111 such that the first vertical plate 123 of the first clamping element 121 faces the second vertical plate 133 of the second clamping element 131. The second clamping element 131 forms a rectilinear structure. The second clamping element 131 comprises a second horizontal plate 132, a second vertical plate 133, and a second gusset 134.

The second horizontal plate 132 is a rectangular plate structure. The second horizontal plate 132 is a disk. The second horizontal plate 132 is the structure of the second clamping element 131 that rests on the superior face 196 of the master plate 111. A face of the second horizontal plate 132 rests on the superior face 196 of the master plate 111. The second horizontal plate 132 further comprises a third bolt hole 135 and a fourth bolt hole 136.

The third bolt hole 135 is a negative space formed through the faces of the disk shape of the second horizontal plate 132. The third bolt hole 135 has a cylindrical shape. The center axis of the third bolt hole 135 is perpendicular to the faces of the second horizontal plate 132. The third bolt hole 135 is sized to receive a clamping bolt 142 of an individual fastening structure 141 selected from the plurality of fastening structures 103. The position of the third bolt hole 135 on the master plate 111 aligns with an adjustment structure selected from the plurality of adjustment structures 112 such that the selected clamping bolt 142 will insert into the selected alignment structure.

The fourth bolt hole 136 is a negative space formed through the faces of the disk shape of the second horizontal plate 132. The fourth bolt hole 136 has a cylindrical shape. The center axis of the fourth bolt hole 136 is perpendicular to the faces of the second horizontal plate 132. The fourth bolt hole 136 is sized to receive a clamping bolt 142 of an individual fastening structure 141 selected from the plurality of fastening structures 103. The position of the fourth bolt hole 136 on the master plate 111 aligns with an adjustment structure selected from the plurality of adjustment structures 112 such that the selected clamping bolt 142 will insert into the selected alignment structure.

The second vertical plate 133 is a rectangular plate structure. The second vertical plate 133 is a disk. The second vertical plate 133 attaches to the second horizontal plate 132 such that the faces of the second vertical plate 133 are perpendicular to the faces of the second horizontal plate 132. A lateral edge of the second vertical plate 133 rests on the superior face 196 of the master plate 111. The second vertical plate 133 forms the vertical surface of the second clamping element 131 that presses against the workpiece 104.

The second gusset 134 is a plate structure. The second gusset 134 is a disk. The second gusset 134 has a right triangular shape. The second gusset 134 attaches the second horizontal plate 132 to the second vertical plate 133 such that the hypotenuse of the second gusset 134 is parallel to neither: a) the faces of the second horizontal plate 132; nor, b) the faces of the second vertical plate 133. The second gusset 134 forms a bracing structure that holds the second vertical plate 133 in a fixed position when the second vertical plate 133 presses against the workpiece 104.

The plurality of fastening structures 103 is a mechanical structure that removably attaches the plurality of clamping elements 102 to the pedestal 101. The plurality of fastening structures 103 fixes the plurality of clamping elements 102 in a set position on the pedestal 101. The plurality of fastening structures 103 forms a plurality of threaded connections for this purpose. The plurality of fastening structures 103 comprises a collection of individual fastening structure 141. Each of the individual fastening structure 141 is identical.

The individual fastening structure 141 is a fastening device. The individual fastening structure 141 forms a threaded connection that attaches a clamping element selected from the plurality of clamping elements 102 to the master plate 111 of the pedestal 101. The individual fastening structure 141 removably attaches the selected clamping element to the master plate 111. Each individual fastening structure 141 comprises a clamping bolt 142, a sliding spacer 143, and an elongated nut 144. The clamping bolt 142 is further defined with a bolt outer diameter 161. The sliding spacer 143 is further defined with a spacer inner diameter 162 and a spacer inner diameter 162. The elongated nut 144 is further defined with an elongated nut major axis 165 and an elongated nut minor axis 166.

The bolt outer diameter 161 is the outer diameter of the clamping bolt 142. The spacer inner diameter 162 is the inner diameter of the sliding spacer 143. The spacer outer diameter 163 is the outer diameter of the sliding spacer 143. The span of the spacer outer diameter 163 is less than the slot minor axis 157. The elongated nut major axis 165 is the major axis of the rounded rectangle that forms the prism structure of the elongated nut 144. The elongated nut major axis 165 is the minor axis of the rounded rectangle that forms the prism structure of the elongated nut 144.

The clamping bolt 142 is a commercially available cylindrical shaft formed with an exterior screw thread. The outer diameter of the clamping bolt 142 is sized such that the clamping bolt 142 will insert through a bolt hole selected from the group consisting of the first bolt hole 125, the second bolt hole 126, the third bolt hole 135, and the fourth bolt hole 136. The span of the outer diameter of the clamping bolt 142 is less than the span of the spacer inner diameter 162 of the sliding spacer 143 such that the clamping bolt 142 will insert through the sliding spacer 143. The span of the outer diameter of the clamping bolt 142 is less than the span of the slot minor axis 157 of the superior slot 153 such that the clamping bolt 142 will insert through the superior slot 153.

The sliding spacer 143 is a cylindrically shaped spacer. The spacer is defined in greater detail elsewhere in this disclosure. The span of the outer diameter of the sliding spacer 143 is less than the span of the slot minor axis 157 of the superior slot 153 such that the sliding spacer 143 will insert into the superior slot 153. The sliding spacer 143 fits in the superior slot 153 such that the sliding spacer 143 will slide within the superior slot 153 in the direction of the slot major axis 156. The sliding spacer 143 remains within the superior slot 153 when the individual fastening structure 141 attaches to the plurality of adjustment structures 112 such that the clamping bolt 142 will not have any play within the superior slot 153 during use of the invention 100.

The elongated nut 144 is a plate structure. The elongated nut 144 is a disk. The elongated nut 144 has a rounded rectangular face. The elongated nut 144 further comprises a nut hole 164. The nut hole 164 is an aperture formed through the faces of the disk structure of the elongated nut 144. The nut hole 164 is formed with an interior screw thread sized to receive the clamping bolt 142. The center axis of the nut hole 164 aligns with the center of the elongated nut 144. The elongated nut 144 secures the individual fastening structure 141 to the inferior face 195 of the master plate 111.

The span of the length of the elongated nut major axis 165 of the elongated nut 144 is less than the span of the length of the recess major axis 154 of the inferior recess 152 such that the elongated nut 144 will fit into the inferior recess 152. The span of the length of the elongated nut minor axis 166 of the elongated nut 144 is less than the span of the length of the recess minor axis 155 of the inferior recess 152 such that the elongated nut 144 will fit into the inferior recess 152. The elongated nut 144 fits into the inferior recess 152 such that the elongated nut 144 will slide within the clamping bolt 142 in the direction of the recess major axis 154 of the inferior recess 152.

The elongated nut 144 of the individual fastening structure 141 inserts into the inferior recess 152 through the opening formed in the inferior face 195 of the master plate 111.

The following seven paragraphs describe the details of the first potential embodiment of the disclosure.

The plurality of adjustment structures 112 further comprises a first adjustment structure 171, a second adjustment structure 172, a third adjustment structure 173, and a fourth adjustment structure 174.

The first adjustment structure 171 is the adjustment structure selected from the plurality of adjustment structures 112 that aligns with the first bolt hole 125 of the first clamping element 121. The first adjustment structure 171 forms the anchor point used by the first fastening structure 181.

The second adjustment structure 172 is the adjustment structure selected from the plurality of adjustment structures 112 that aligns with the second bolt hole 126 of the first clamping element 121. The second adjustment structure 172 forms the anchor point used by the second fastening structure 182.

The third adjustment structure 173 is the adjustment structure selected from the plurality of adjustment structures 112 that aligns with the third bolt hole 135 of the second clamping element 131. The third adjustment structure 173 forms the anchor point used by the third fastening structure 183.

The fourth adjustment structure 174 is the adjustment structure selected from the plurality of adjustment structures 112 that aligns with the fourth bolt hole 136 of the second clamping element 131. The fourth adjustment structure 174 forms the anchor point used by the fourth fastening structure 184.

The plurality of fastening structures 103 further comprises a first fastening structure 181, a second fastening structure 182, a third fastening structure 183, and a fourth fastening structure 184.

The first fastening structure 181 is the fastening structure selected from the plurality of fastening structures 103 that anchors the first clamping element 121 to the first adjustment structure 171. The second fastening structure 182 is the fastening structure selected from the plurality of fastening structures 103 that anchors the first clamping element 121 to the second adjustment structure 172. The third fastening structure 183 is the fastening structure selected from the plurality of fastening structures 103 that anchors the second horizontal plate 132 to the third adjustment structure 173. The fourth fastening structure 184 is the fastening structure selected from the plurality of fastening structures 103 that anchors the second horizontal plate 132 to the fourth adjustment structure 174.

The following five paragraphs describe the assembly of the invention 100.

The clamping bolt 142 of the first fastening structure 181 inserts through the first bolt hole 125 of the first horizontal plate 122. The sliding spacer 143 of the first fastening structure 181 inserts into the superior slot 153 of the first adjustment structure 171. The clamping bolt 142 of the first fastening structure 181 inserts through the sliding spacer 143 of the first fastening structure 181. The elongated nut 144 of the first fastening structure 181 inserts into the inferior recess 152 of the first adjustment structure 171. The clamping bolt 142 of the first fastening structure 181 inserts into the nut hole 164 of the elongated nut 144 of the first fastening structure 181.

The clamping bolt 142 of the second fastening structure 182 inserts through the second bolt hole 126 of the first horizontal plate 122. The sliding spacer 143 of the second fastening structure 182 inserts into the superior slot 153 of the second adjustment structure 172. The clamping bolt 142 of the second fastening structure 182 inserts through the sliding spacer 143 of the second fastening structure 182. The elongated nut 144 of the second fastening structure 182 inserts into the inferior recess 152 of the second adjustment structure 172. The clamping bolt 142 of the second fastening structure 182 inserts into the nut hole 164 of the elongated nut 144 of the second fastening structure 182.

The clamping bolt 142 of the third fastening structure 183 inserts through the third bolt hole 135 of the second horizontal plate 132. The sliding spacer 143 of the third fastening structure 183 inserts into the superior slot 153 of the third adjustment structure 173. The clamping bolt 142 of the third fastening structure 183 inserts through the sliding spacer 143 of the third fastening structure 183. The elongated nut 144 of the third fastening structure 183 inserts into the inferior recess 152 of the third adjustment structure 173. The clamping bolt 142 of the third fastening structure 183 inserts into the nut hole 164 of the elongated nut 144 of the third fastening structure 183.

The clamping bolt 142 of the fourth fastening structure 184 inserts through the fourth bolt hole 136 of the second horizontal plate 132. The sliding spacer 143 of the fourth fastening structure 184 inserts into the superior slot 153 of the fourth adjustment structure 174. The clamping bolt 142 of the fourth fastening structure 184 inserts through the sliding spacer 143 of the fourth fastening structure 184. The elongated nut 144 of the fourth fastening structure 184 inserts into the inferior recess 152 of the fourth adjustment structure 174. The clamping bolt 142 of the fourth fastening structure 184 inserts into the nut hole 164 of the elongated nut 144 of the fourth fastening structure 184.

The first clamping element 121 is positioned along the superior face 196 of the master plate 111 by sliding the first clamping element 121 along the recess major axis 154 of the first adjustment structure 171 and the second adjustment structure 172 before tightening the first fastening structure 181 and the second fastening structure 182. The second clamping element 131 is positioned along the superior face 196 of the master plate 111 by sliding the second clamping element 131 along the recess major axis 154 of the third adjustment structure 173 and the fourth adjustment structure 174 before tightening the third fastening structure 183 and the fourth fastening structure 184.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Aperture: As used in this disclosure, an aperture is a prism-shaped negative space that is formed completely through a structure or the surface of a structure.

Bolt: As used in this disclosure, a bolt is a cylindrical shaft that is formed with an exterior screw thread. A bolt is defined with an outer diameter.

Brace: As used in this disclosure, a brace is a structural element that is used to support or otherwise steady an object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Diametrically Opposed: As used in this disclosure, diametrically opposed is a term that describes the locations of a first object and a second object located at opposite ends of a diameter drawn through a third object. The term diametric opposition can also be used to describe this relationship.

Disk: As used in this disclosure, a disk is a prism-shaped object that is flat in appearance. Specifically, the sum of the surface areas of two ends of the prism-shaped object that forms the disk is greater than the surface area of lateral face of the prism-shaped object that forms the disk. In this disclosure, the ends of the prism-shaped structure that forms the disk are referred to as the faces of the disk.

Exterior Screw Thread: An exterior screw thread is a ridge wrapped around the outer surface of a tube in the form of a helical structure that is used to convert rotational movement into linear movement.

Fastener: As used in this disclosure, a fastener is a device that is used to removably attach a first object to a second object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Gusset: As used in this disclosure, a gusset is an angled structural member used to form a portion of the load path of a section of a framework. By angled is meant that the gusset is neither parallel nor perpendicular to the force of gravity.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Inner Diameter: As used in this disclosure, the term inner diameter is used in the same way that a plumber would refer to the inner diameter of a pipe.

Interior Screw Thread: An interior screw thread is a groove that is formed around the inner surface of a tube in the form of a helical structure that is used to convert rotational movement into linear movement.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to an edge of a rectangular or rectilinear structure.

Negative Space: As used in this disclosure, negative space is a method of defining an object through the use of open or empty space as the definition of the object itself, or, through the use of open or empty space to describe the boundaries of an object.

Nut: As used in this disclosure, a nut is a first object that is formed with a cylindrical negative space that further comprises an interior screw thread such that a second object with a matching exterior screw thread can screwed into the first object forming a threaded connection. A nut is further defined with an inner diameter.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Diameter: As used in this disclosure, the term outer diameter is used in the same way that a plumber would refer to the outer diameter of a pipe.

Oval: As used in this disclosure, an oval is a geometric shape that is formed in the shape of a "squished" circle similar in form to an ellipse. The difference between an oval and an ellipse is that an ellipse can be described by a mathematical formula while an oval has no such description. The term ovoid refers to a three-dimensional structure with an oval shape that is analogous to the relationship of an ellipsoid and an ellipse.

Pedestal: As used in this disclosure, a pedestal is an intermediary load bearing structure that that transfers a load path between a supporting surface and an object, structure, or load.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular or disk like appearance. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Rectangular Block: As used in this disclosure, a rectangular block refers to a three-dimensional structure comprising six rectangular surfaces (commonly called faces) formed at right angles. Within this disclosure, a rectangular block may further comprise rounded edges and corners.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Screw: As used in this disclosure, to screw is a verb meaning: 1) to fasten or unfasten (unscrew) a threaded connection; or 2) to attach a helical structure to a solid structure.

Screw: As used in this disclosure, a screw is a cylindrical, or tapered cylindrical, structure that is formed with an exterior screw thread. A screw is used to attach a first object to a second object. Screws are well known and documented in the mechanical arts.

Spacer: As used in this disclosure, a spacer is a prism-shaped disk that is formed with a cylindrical negative space that allows a shaft to be inserted through the faces of the disk. A spacer is further defined with an inner diameter.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A bench device comprising:

a pedestal, a plurality of clamping elements, and a plurality of fastening structures;

wherein the plurality of fastening structures attach the plurality of clamping elements to the pedestal;

wherein the bench device maintains a workpiece in a fixed position;

wherein the plurality of clamping elements hold the workpiece in a fixed position;

wherein the bench device allow the plurality of clamping elements to slide along the pedestal;

wherein the pedestal forms the inferior structure of the bench device;

wherein the pedestal is a plate structure;

wherein the pedestal has a disk shape;

wherein the pedestal has a rectangular block shape;

wherein the inferior face of the pedestal rests on a supporting surface;

wherein the plurality of fastening structures removably attaches the plurality of clamping elements to the superior face of the pedestal;

wherein the plurality of fastening structures attaches the plurality of clamping elements to the superior face such that the position of each of the plurality of clamping elements is adjustable;

wherein the plurality of clamping elements form two vertical surfaces that press against the workpiece such that the workpiece is held in the fixed position;

wherein the position of each of the plurality of clamping elements on the superior face of the pedestal is adjustable.

2. The bench device according to claim 1 wherein the pedestal comprises a master plate and a plurality of adjustment structures;

wherein the plurality of adjustment structures are formed in the master plate;

wherein the master plate is a rectangular plate structure;

wherein the master plate forms a disk structure;

wherein the master plate is further defined with a first lateral edge, a second lateral edge, a third lateral edge, a fourth lateral edge, an inferior face, a superior face, a plate major axis, and a plate minor axis;

wherein the plurality of adjustment structures comprises a collection of individual adjustment structures;

wherein each of the individual adjustment structure is identical.

3. The bench device according to claim 2 wherein each of the individual adjustment structure is a negative space formed in the master plate;

wherein the individual adjustment structure has a composite prism structure;

wherein the individual adjustment structure forms an anchor point to which a fastening structure selected from the plurality of fastening structures attaches.

4. The bench device according to claim 3 wherein each individual adjustment structure comprises an inferior recess and a superior slot;

wherein the inferior recess is a negative space that forms a cavity within the master plate;

wherein the superior slot is a negative space that forms a cavity within the master plate;

wherein the inferior recess is further defined with a recess major axis and a recess minor axis;

wherein the superior slot is further defined with a slot major axis and a slot minor axis.

5. The bench device according to claim 4 wherein the inferior recess forms a disk structure;

wherein the inferior recess has an oval prism shape;

wherein the inferior recess is formed in the master plate such that a face of the inferior recess forms an opening through the inferior face of the master plate;

wherein the face of the inferior recess that is distal from the inferior face is formed within the interior of the master plate;

wherein the superior slot has a disk structure;

wherein the superior slot is formed in the master plate such that a face of the superior slot forms an opening through the superior face of the master plate;

wherein the superior slot is formed in the master plate such that a face of the superior slot forms an opening into the inferior recess.

6. The bench device according to claim 5 wherein the superior slot is positioned relative to the inferior recess such that the negative spaces of the superior slot and the inferior recess combine to form a negative space in the shape of a composite prism within the master plate.

7. The bench device according to claim 6 wherein the span of the length of the slot major axis is less than the span of the length of the recess major axis;

wherein the span of the length of the slot minor axis is less than the span of the length of the recess minor axis;

wherein the span of the length of the recess minor axis is less than the span of the length of the recess major axis;

wherein the span of the length of the slot minor axis is less than the span of the length of the slot major axis.

8. The bench device according to claim 7 wherein the plurality of clamping elements comprises a first clamping element and a second clamping element;

wherein the first clamping element forms a first element of the plurality of clamping elements;

wherein the second clamping element forms a first second of the plurality of clamping elements;

wherein the first clamping element presses against the workpiece from a first side to hold the workpiece in position;

wherein the second clamping element presses against the workpiece from a second side to hold the workpiece in position;

wherein the position of the second clamping element is positioned against the workpiece in diametric opposition to the first clamping element;

wherein the second clamping element is positioned on the master plate such that the first vertical plate of the first clamping element faces the second vertical plate of the second clamping element.

9. The bench device according to claim 8 wherein the first clamping element comprises a first horizontal plate, a first vertical plate, and a first gusset;

wherein the first horizontal plate is a rectangular plate structure;

wherein the first horizontal plate is a disk;

wherein a face of the first horizontal plate rests on the superior face of the master plate;

wherein the first vertical plate is a rectangular plate structure;

wherein the first vertical plate is a disk;

wherein the first vertical plate attaches to the first horizontal plate such that the faces of the first vertical plate are perpendicular to the faces of the first horizontal plate;

wherein a lateral edge of the first vertical plate rests on the superior face of the master plate;

wherein the first gusset is a plate structure;

wherein the first gusset is a disk;

wherein the first gusset has a right triangular shape;

wherein the first gusset attaches the first horizontal plate to the first vertical plate such that the hypotenuse of the first gusset is parallel to neither: a) the faces of the first horizontal plate; nor, b) the faces of the first vertical plate.

10. The bench device according to claim 9 wherein the second clamping element comprises a second horizontal plate, a second vertical plate, and a second gusset;

wherein the second horizontal plate is a rectangular plate structure;

wherein the second horizontal plate is a disk;

wherein a face of the second horizontal plate rests on the superior face of the master plate;

wherein the second vertical plate is a rectangular plate structure;

wherein the second vertical plate is a disk;

wherein the second vertical plate attaches to the second horizontal plate such that the faces of the second vertical plate are perpendicular to the faces of the second horizontal plate;

wherein a lateral edge of the second vertical plate rests on the superior face of the master plate;

wherein the second gusset is a plate structure;

wherein the second gusset is a disk;

wherein the second gusset has a right triangular shape;

wherein the second gusset attaches the second horizontal plate to the second vertical plate such that the hypotenuse of the second gusset is parallel to neither: a) the faces of the second horizontal plate; nor, b) the faces of the second vertical plate.

11. The bench device according to claim 10 wherein the first horizontal plate further comprises a first bolt hole and a second bolt hole;

wherein the first bolt hole is a negative space formed through the faces of the disk shape of the first horizontal plate;

wherein the first bolt hole has a cylindrical shape;

wherein the center axis of the first bolt hole is perpendicular to the faces of the first horizontal plate;

wherein the first bolt hole is sized to receive a clamping bolt of an individual fastening structure selected from the plurality of fastening structures;

wherein the position of the first bolt hole on the master plate aligns with an adjustment structure selected from the plurality of adjustment structures such that the selected clamping bolt will insert into the selected alignment structure;

wherein the second bolt hole is a negative space formed through the faces of the disk shape of the first horizontal plate;

wherein the second bolt hole has a cylindrical shape;

wherein the center axis of the second bolt hole is perpendicular to the faces of the first horizontal plate;

wherein the second bolt hole is sized to receive a clamping bolt of an individual fastening structure selected from the plurality of fastening structures;

wherein the position of the second bolt hole on the master plate aligns with an adjustment structure selected from the plurality of adjustment structures such that the selected clamping bolt will insert into the selected alignment structure.

12. The bench device according to claim 11 wherein the second horizontal plate further comprises a third bolt hole and a fourth bolt hole;

wherein the third bolt hole is a negative space formed through the faces of the disk shape of the second horizontal plate;

wherein the third bolt hole has a cylindrical shape;

wherein the center axis of the third bolt hole is perpendicular to the faces of the second horizontal plate;

wherein the third bolt hole is sized to receive a clamping bolt of an individual fastening structure selected from the plurality of fastening structures;

wherein the position of the third bolt hole on the master plate aligns with an adjustment structure selected from the plurality of adjustment structures such that the selected clamping bolt will insert into the selected alignment structure;

wherein the fourth bolt hole is a negative space formed through the faces of the disk shape of the second horizontal plate;

wherein the fourth bolt hole has a cylindrical shape;

wherein the center axis of the fourth bolt hole is perpendicular to the faces of the second horizontal plate;

wherein the fourth bolt hole is sized to receive a clamping bolt of an individual fastening structure selected from the plurality of fastening structures;

wherein the position of the fourth bolt hole on the master plate aligns with an adjustment structure selected from the plurality of adjustment structures such that the selected clamping bolt will insert into the selected alignment structure.

13. The bench device according to claim 12 wherein the plurality of fastening structures comprises a collection of individual fastening structure;

wherein each of the individual fastening structure is identical;

wherein the individual fastening structure forms a threaded connection that attaches a clamping element selected from the plurality of clamping elements to the master plate of the pedestal;

wherein the individual fastening structure removably attaches the selected clamping element to the master plate.

14. The bench device according to claim 13 wherein each individual fastening structure comprises a clamping bolt, a sliding spacer, and an elongated nut;

wherein the clamping bolt inserts through the sliding spacer;

wherein the clamping bolt screws into the elongated nut;

wherein the superior slot provides access into the inferior recess for the clamping bolt;

wherein the clamping bolt is further defined with a bolt outer diameter;

wherein the sliding spacer is further defined with a spacer inner diameter and a spacer inner diameter;

wherein the elongated nut is further defined with an elongated nut major axis and an elongated nut minor axis.

15. The bench device according to claim 14 wherein the clamping bolt is a cylindrical shaft formed with an exterior screw thread;

wherein the outer diameter of the clamping bolt is sized such that the clamping bolt will insert through a bolt hole selected from the group consisting of the first bolt hole, the second bolt hole, the third bolt hole, and the fourth bolt hole;

wherein the span of the outer diameter of the clamping bolt is less than the span of the spacer inner diameter of the sliding spacer such that the clamping bolt will insert through the sliding spacer;

wherein the span of the outer diameter of the clamping bolt is less than the span of the slot minor axis of the superior slot such that the clamping bolt will insert through the superior slot;

wherein the sliding spacer is cylindrically shaped;

wherein the span of the outer diameter of the sliding spacer is less than the span of the slot minor axis of the superior slot such that the sliding spacer will insert into the superior slot;

wherein the sliding spacer fits in the superior slot such that the sliding spacer will slide within the superior slot in the direction of the slot major axis;

wherein the elongated nut is a plate structure;

wherein the elongated nut is a disk;

wherein the elongated nut has a rounded rectangular face;

wherein the elongated nut further comprises a nut hole;

wherein the nut hole is an aperture formed through the faces of the disk structure of the elongated nut;

wherein the nut hole is formed with an interior screw thread sized to receive the clamping bolt;

wherein the center axis of the nut hole aligns with the center of the elongated nut;

wherein the elongated nut secures the individual fastening structure to the inferior face of the master plate.

16. The bench device according to claim 15 wherein the span of the length of the elongated nut major axis of the elongated nut is less than the span of the length of the recess major axis of the inferior recess such that the elongated nut will fit into the inferior recess;

wherein the span of the length of the elongated nut minor axis of the elongated nut is less than the span of the length of the recess minor axis of the inferior recess such that the elongated nut will fit into the inferior recess;

wherein the elongated nut fits into the inferior recess such that the elongated nut will slide within the clamping bolt in the direction of the recess major axis of the inferior recess;

wherein the elongated nut of the individual fastening structure inserts into the inferior recess through the opening formed in the inferior face of the master plate.

17. The bench device according to claim 16 wherein the plurality of adjustment structures further comprises a first adjustment structure, a second adjustment structure, a third adjustment structure, and a fourth adjustment structure;

wherein the first adjustment structure is the adjustment structure selected from the plurality of adjustment structures that aligns with the first bolt hole of the first clamping element;

wherein the first adjustment structure forms an anchor point;

wherein the second adjustment structure is the adjustment structure selected from the plurality of adjustment structures that aligns with the second bolt hole of the first clamping element;

wherein the second adjustment structure forms an anchor point;

wherein the third adjustment structure is the adjustment structure selected from the plurality of adjustment structures that aligns with the third bolt hole of the second clamping element;

wherein the third adjustment structure forms an anchor point;

wherein the fourth adjustment structure is the adjustment structure selected from the plurality of adjustment structures that aligns with the fourth bolt hole of the second clamping element;

wherein the fourth adjustment structure forms an anchor point.

18. The bench device according to claim 17 wherein the plurality of fastening structures further comprises a first fastening structure, a second fastening structure, a third fastening structure, and a fourth fastening structure;

wherein the first fastening structure is the fastening structure selected from the plurality of fastening structures that anchors the first clamping element to the first adjustment structure;

wherein the second fastening structure is the fastening structure selected from the second fastening structure that anchors the first clamping element to the second adjustment structure;

wherein the third fastening structure is the fastening structure selected from the third fastening structure that anchors the second horizontal plate to the third adjustment structure;

wherein the fourth fastening structure is the fastening structure selected from the fourth fastening structure that anchors the second horizontal plate to the fourth adjustment structure.

19. The bench device according to claim 18 wherein the clamping bolt of the first fastening structure inserts through the first bolt hole of the first horizontal plate;

wherein the sliding spacer of the first fastening structure inserts into the superior slot of the first adjustment structure;

wherein the clamping bolt of the first fastening structure inserts through the sliding spacer of the first fastening structure;

wherein the elongated nut of the first fastening structure inserts into the inferior recess of the first adjustment structure;

wherein the clamping bolt of the first fastening structure inserts into the nut hole of the elongated nut of the first fastening structure;

wherein the clamping bolt of the second fastening structure inserts through the second bolt hole of the first horizontal plate;

wherein the sliding spacer of the second fastening structure inserts into the superior slot of the second adjustment structure;

wherein the clamping bolt of the second fastening structure inserts through the sliding spacer of the second fastening structure;

wherein the elongated nut of the second fastening structure inserts into the inferior recess of the second adjustment structure;

wherein the clamping bolt of the second fastening structure inserts into the nut hole of the elongated nut of the second fastening structure;

wherein the clamping bolt of the third fastening structure inserts through the third bolt hole of the second horizontal plate;

wherein the sliding spacer of the third fastening structure inserts into the superior slot of the third adjustment structure;

wherein the clamping bolt of the third fastening structure inserts through the sliding spacer of the third fastening structure;

wherein the elongated nut of the third fastening structure inserts into the inferior recess of the third adjustment structure;

wherein the clamping bolt of the third fastening structure inserts into the nut hole of the elongated nut of the third fastening structure;

wherein the clamping bolt of the fourth fastening structure inserts through the fourth bolt hole of the second horizontal plate;

wherein the sliding spacer of the fourth fastening structure inserts into the superior slot of the fourth adjustment structure;

wherein the clamping bolt of the fourth fastening structure inserts through the sliding spacer of the fourth fastening structure;

wherein the elongated nut of the fourth fastening structure inserts into the inferior recess of the fourth adjustment structure;

wherein the clamping bolt of the fourth fastening structure inserts into the nut hole of the elongated nut of the fourth fastening structure;

wherein the first clamping element is positioned along the superior face of the master plate by sliding the first clamping element along the recess major axis of the first adjustment structure and the second adjustment structure before tightening the first fastening structure and the second fastening structure;

wherein the second clamping element is positioned along the superior face of the master plate by sliding the second clamping element along the recess major axis of the third adjustment structure and the fourth adjustment structure before tightening the third fastening structure and the fourth fastening structure;

wherein the recess major axis is parallel to the first lateral edge of the master plate;

wherein the recess minor axis is the minor axis of the oval that forms the prism structure of the inferior recess;

wherein the recess major axis is parallel to the second lateral edge of the master plate;

wherein the slot major axis is the major axis of the oval that forms the prism structure of the superior slot;

wherein the slot major axis is parallel to the first lateral edge of the master plate;

wherein the slot minor axis is the minor axis of the oval that forms the prism structure of the superior slot;

wherein the slot minor axis is parallel to the second lateral edge of the master plate.

* * * * *